US007243641B2

(12) United States Patent
Zukouski

(10) Patent No.: US 7,243,641 B2
(45) Date of Patent: Jul. 17, 2007

(54) TANGENTIAL MIXER AND METHOD

(75) Inventor: Russell P. Zukouski, Bolingbrook, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 11/207,854

(22) Filed: Aug. 18, 2005

(65) Prior Publication Data

US 2007/0039597 A1 Feb. 22, 2007

(51) Int. Cl.

| | |
|---|---|
| ***F02M 35/07*** | (2006.01) |
| ***F02M 29/00*** | (2006.01) |
| ***F02B 47/08*** | (2006.01) |
| *F02B 33/44* | (2006.01) |

(52) U.S. Cl. ..... 123/568.17; 123/590

(58) Field of Classification Search ..... 123/568.11, 123/568.17, 568.18, 585, 586, 590; 60/602.5
See application file for complete search history.

(56) References Cited

U.S. PATENT DOCUMENTS 2,720,196 A * 10/1955 Otto ..... 123/568.17
4,461,150 A * 7/1984 Grohn ..... 60/605.2
6,138,651 A * 10/2000 Mori et al. ..... 123/568.17
6,267,106 B1 * 7/2001 Feucht ..... 123/568.17
6,272,851 B1 * 8/2001 Mori et al. ..... 123/568.17
6,427,671 B1 * 8/2002 Holze et al. ..... 123/568.17
6,810,867 B2 * 11/2004 Schmid et al. ..... 123/568.17
2003/0015596 A1 1/2003 Evans

FOREIGN PATENT DOCUMENTS

EP 1415957 A1 * 5/2004

* cited by examiner

*Primary Examiner*—Willis R. Wolfe, Jr.
(74) *Attorney, Agent, or Firm*—Elias P. Soupos; Susan L. Lukasik; Jeffrey P. Calfa

(57) ABSTRACT

An apparatus includes a tangential mixer (200) having an air inlet (207) and a mixture outlet (209). A bore (205) has a bore centerline (213) and a bore perimeter (201). At least one gas inlet (211) has an inlet centerline (215) oriented tangentially to the bore perimeter (201). The inlet centerline (215) is within a cone (300). The cone (300) has a vertex point "A" on the inlet centerline (215).

15 Claims, 4 Drawing Sheets

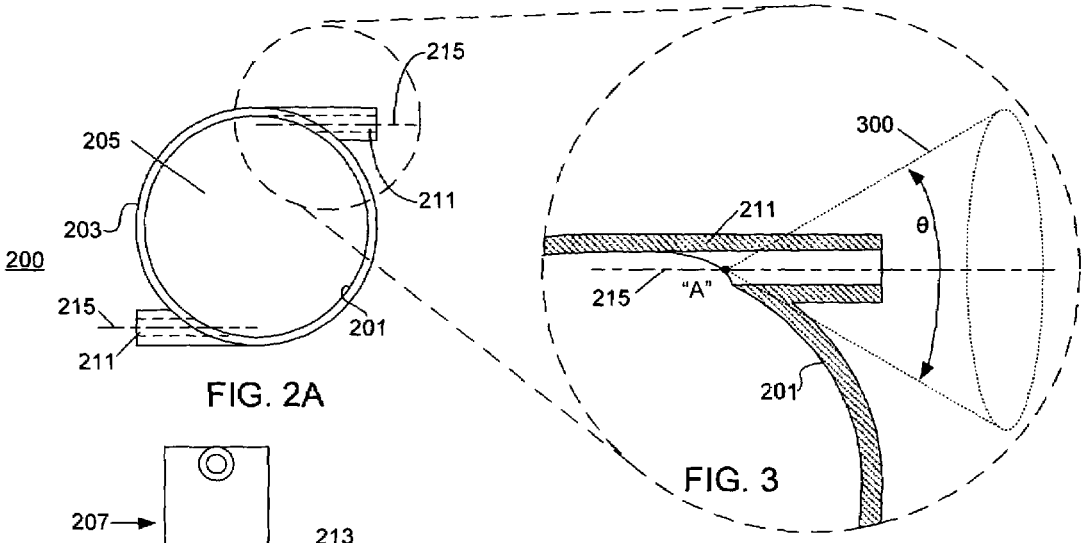
FIG. 2A
FIG. 3
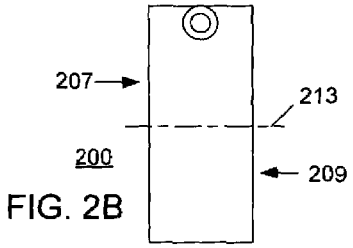
FIG. 2B
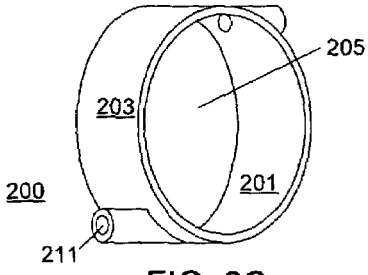
FIG. 2C
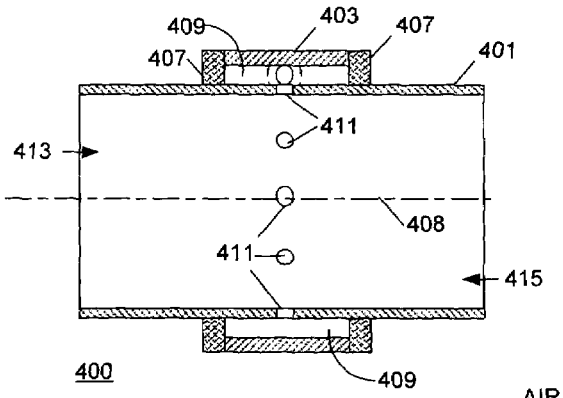
FIG. 4A
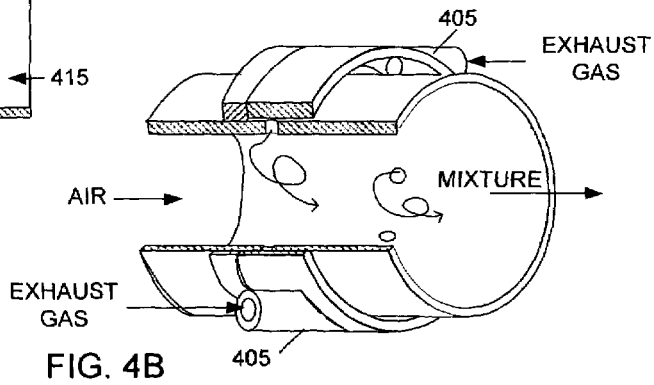
FIG. 4B

TANGENTIAL MIXER AND METHOD

FIELD OF THE INVENTION

This invention relates to internal combustion engines, including but not limited to engines having Exhaust Gas Recirculation (EGR) systems.

BACKGROUND OF THE INVENTION

Most internal combustion engines have some type of emission control devices. One type, common to many engines, is recirculation of exhaust gas from an exhaust system to an intake system of the engine. A high pressure EGR system recirculates exhaust gas typically from upstream of a turbine, or other similar device, to downstream of a compressor. Other systems recirculate gas at a low pressure, and are called low-pressure systems. An engine having a high-pressure EGR system has a junction somewhere in the air intake system where EGR gas and intake air mix to form a mixture. The mixture of exhaust gas and intake air is consumed during engine operation.

Providing each cylinder of an internal combustion engine with a homogeneous mixture of exhaust gas and air is advantageous for operation. A homogeneous mixture promotes efficient operation of the engine because the emission and power output of each cylinder is uniform. The homogeneity of the mixture provided to each cylinder becomes a design parameter of special importance for engines running a considerable amount of EGR over a wide range of engine operating points.

Many methods devised in the past were intended to improve mixing of exhaust gas with intake air for engines having an EGR system. These methods typically use flow obstructions that increase turbulence in the intake air, the exhaust gas, or the mixture of intake air and exhaust gas, to improve the homogeneity of the mixture supplied to the engine's cylinders. Such methods, although typically fairly effective, have the disadvantage of increasing pressure losses in the intake system of the engine as a result of increased turbulence in the intake air or in the intake mixture. Increased pressure losses in the intake system of an engine leads to decreased engine efficiency and increased fuel consumption.

Accordingly, there is a need for effective mixing of exhaust gas with intake air in an engine having an EGR system that does not decrease the engine efficiency or increase fuel consumption.

SUMMARY OF THE INVENTION

An internal combustion engine includes a crankcase having a plurality of cylinders in fluid communication with an inlet system and an exhaust system. A turbocharger and an exhaust gas recirculation system are in fluid communication with the intake system and the exhaust system. The tangential mixer is disposed in the intake system and fluidly communicates with the exhaust system.

The tangential mixer has a bore, an air inlet side, a mixture outlet side, and at least one gas inlet. The bore has a bore centerline and a bore perimeter. The gas inlet has an inlet centerline oriented tangentially to the bore perimeter. In general, the inlet centerline is within an imaginary cone, the cone having a vertex point lying on the inlet centerline.

A first fluid flows through the bore. A second fluid enters through an inlet. The first fluid and the second fluid are mixed to yield a mixture. The first fluid flows in a first direction and the second fluid flows in a second direction. The first direction and the second direction are at an angle, thus, the mixture has a spiral flow pattern.

BRIEF DESCRIPTION OF THE DRAWINGS

FIG. 2A is a front view of a tangential mixer in accordance with the invention.

FIG. 2B is a side view of the tangential mixture in accordance with the invention.

FIG. 2C is an isometric view of the tangential mixture in accordance with the invention.

FIG. 3 is a detail section view of an exhaust gas inlet of the tangential mixture in accordance with the invention.

FIG. 4A is a side view in section of a tangential mixer having an inner bore in accordance with the invention.

FIG. 4B is an isometric view in partial section of the tangential mixer of FIG. 4A in accordance with the invention.

DESCRIPTION OF A PREFERRED EMBODIMENT

The following describes an apparatus for and method of mixing recirculated exhaust gas with intake air in an engine having an EGR system, to yield a homogeneous mixture of exhaust gas and intake air. A tangential flow mixer is placed at a junction where the exhaust gas and intake air meet to effectively mix exhaust gas and intake air and yield a homogeneous mixture. The tangential flow mixer does not increase pressure losses in the intake air system, does not increase fuel consumption and does not lower engine efficiency.

Figure 1:
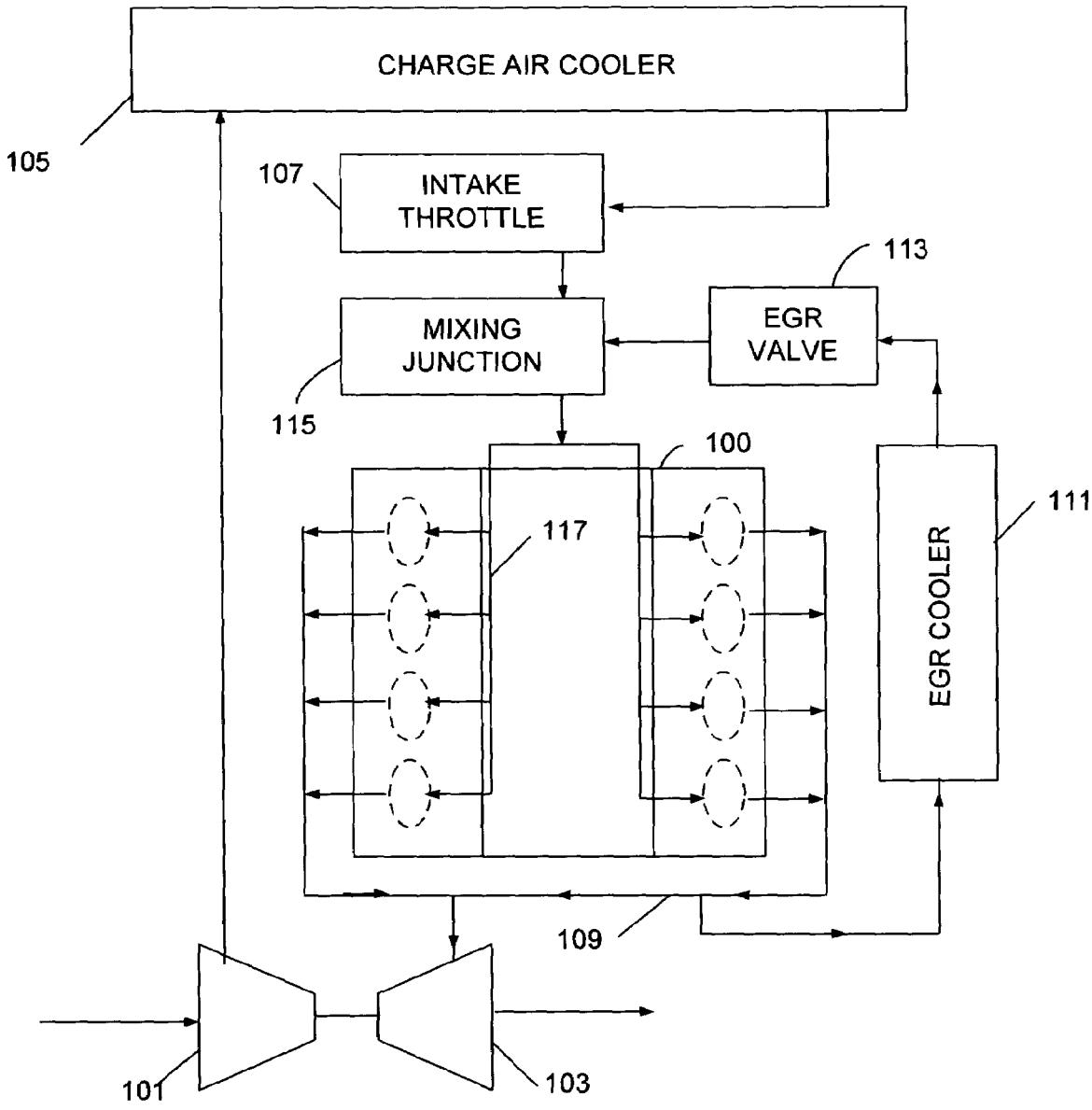
FIG. 1 is a block diagram of an engine in accordance with the invention.

A block diagram of an engine having a high-pressure EGR system is shown in FIG. 1. A base engine 100 contains a plurality of cylinders housed in an engine block. A compressor 101 is connected to an air cleaner (not shown) and a turbine 103. An outlet of the compressor 101 is connected to a charge cooler 105, which in turn is connected to an intake throttle valve 107. The turbine 103 is connected to an exhaust system 109. The exhaust system 109 is connected to the base engine 100 and to an EGR cooler 111. The EGR cooler 111 is connected to an EGR valve 113. The intake throttle valve 107 and the EGR valve 113 are both connected to a junction 115. The junction 115 is connected to an intake system 117. Finally, the intake system 117 is connected to the base engine 100.

During engine operation, air from the air cleaner (not shown) enters the compressor 101, and exhaust gas from the base engine 100 enters the exhaust system 109 with a portion going to operate the turbine 103, and a portion entering the EGR cooler 111. The exhaust gas entering a turbocharger through the turbine 111 forces a turbine wheel (not shown) to rotate and provide power to a compressor wheel (not shown) that compresses air. The compressed air travels from the output of the compressor 101 to the charge cooler 105 where it is cooled. The cooled compressed air then goes to the intake throttle valve 107 where its quantity may be controlled, and enters the junction 115.

Exhaust gas from the exhaust system 109 enters the EGR cooler 111 where it is cooled, and then enters the EGR valve 113. The EGR valve 113 is shown downstream of the EGR cooler 111, but may alternatively be positioned upstream of the EGR cooler 111. The EGR valve 113 controls the quantity of exhaust gas the engine 100 will ingest. The exhaust gas exiting the EGR valve 113 enters the junction 115.

The junction 115 is intended to mix exhaust gas coming from the EGR valve 113 and intake air coming from the intake throttle valve 107 to yield a mixture. The mixture exiting the junction 107 enters the intake system 117 from where it is distributed to the cylinders included in the base engine 100. The homogeneity of the mixture exiting the junction 117 is typically measured indirectly, through measurement of each cylinder's content of carbon dioxide. Carbon dioxide measurements at exhaust ports of each cylinder may be used to infer a percentage of EGR gas that is entering each cylinder, which in turn may be used to infer the homogeneity of the mixture exiting the junction 115. Acceptable levels of mixing of exhaust gas and intake air in the junction 107 may yield a variation of EGR gas input between the cylinders of less than 1.5% of commanded EGR percentage (i.e. a command of 20% EGR, for example, indicates that the mixture exiting the junction 107 includes about 80% by mass of air and 20% by mass of EGR gas; acceptable cylinder to cylinder variation for this condition will be between +/−0.3% of exhaust gas by mass).

The junction 107 may use a tangential mixer 200, as shown in FIG. 2A through FIG. 2C. The tangential mixer 200 has a substantially cylindrical shape having an inner surface 201, an outer surface 203, a bore 205, an air inlet 207, a mixture outlet 209, and two gas inlets 211. The bore 205 may be a segment of an air intake system for an engine, and may take on any shape required for proper placement of the mixer 200 in the intake system. Each gas inlet 211 is an opening that fluidly communicates with the bore 205. In the embodiment shown, each inlet 211 has a cylindrical shape. A bore centerline 213 may be defined in the bore 205. In a case where the bore 205 has a shape other than a cylindrical shape, the bore centerline 213 would be an imaginary line running through the center of gravity of each cross-section of the bore 205. Each of two inlet centerlines 215 may also be defined in each of the two inlets 211. These inlet centerlines 215 are imaginary lines that run along the centerlines of the cylindrical inlets 211. In a case where the inlets 211 have a shape other than a cylindrical shape, the inlet centerlines 215 would be imaginary lines running through each of the center of gravity of each cross-section of the inlets 211.

The orientation of the bore centerline 213 to the inlet centerlines 215 enables effective mixing of exhaust gas with intake air at the inlet of the engine. In the embodiment of FIG. 2A through FIG. 2C, each inlet centerline 215 is advantageously oriented tangentially to a perimeter of the bore 205. In the embodiment shown, the bore centerline 213 is perpendicular to a plane defined by the two inlet centerlines 215. This is not the only orientation that will produce desirable results for mixing. The inlet centerlines 215 may lie anywhere within a right circular cone 300 defined by a vertex point, A, and an angle, θ, as shown in FIG. 3. The vertex A is the center-point of the intersection between the bore 205 and the inlet 211, and lies on the intersection between the inlet centerline 215 and the inner surface 201. The angle θ may advantageously be an included angle of about 90 degrees, but other angles may be used. The optimal value for the angle θ depends on the shape of the inlet system of the engine. For example, if the section of the inlet system that includes the tangential mixer 200 is straight, and there is a moderate flow of air and exhaust gas into the engine (for example, about 50% to 75% of maximum airflow and about 20% to 30% flow of EGR gas), then the angle θ may be zero. Under circumstances where the tangential mixer 200 precedes a bend in the path of the intake air, the angle θ may be different.

A non-zero angle for the angle θ indicates that the inlet 211, and therefore the centerline 215, may be pivoted in three dimensions about point A, and may be oriented anywhere within the cone 300 as shown in FIG. 3. The orientation of the centerline 215 is designed-into the tangential mixture permanently, and its optimization may require a number of design iterations that are verified using engine testing or analytical methods, such as modeling using computational fluid dynamics, and so forth.

In a preferred embodiment the angle θ is zero, indicating that the centerline 213 of the bore 205 is perpendicular to a plane defined by each of the two centerlines 215 of the inlet bores 211. For advantageously improved mixing, an inner bore 401 may be added to the tangential mixer 400, as shown in FIG. 4A and FIG. 4B. The tangential mixer 400 includes the inner bore 401, an outer bore 403, two inlet bores 405, and two end-plates 407. The inner bore 401 fits inside the outer bore 403 and marks out a chamber 409, radially between the outer bore 403 and the inner bore 401, and along a centerline 408 between the end-plates 407. The inner bore 401 has a plurality of diffuser holes 411 formed in its outer wall, in fluid communication with the chamber 409. In an alternate embodiment, there may also be an offset between the two centerlines 215 of the inlet bores 211. The offset could be an offset distance along the centerline 213 of the bore 205.

Figure 5:
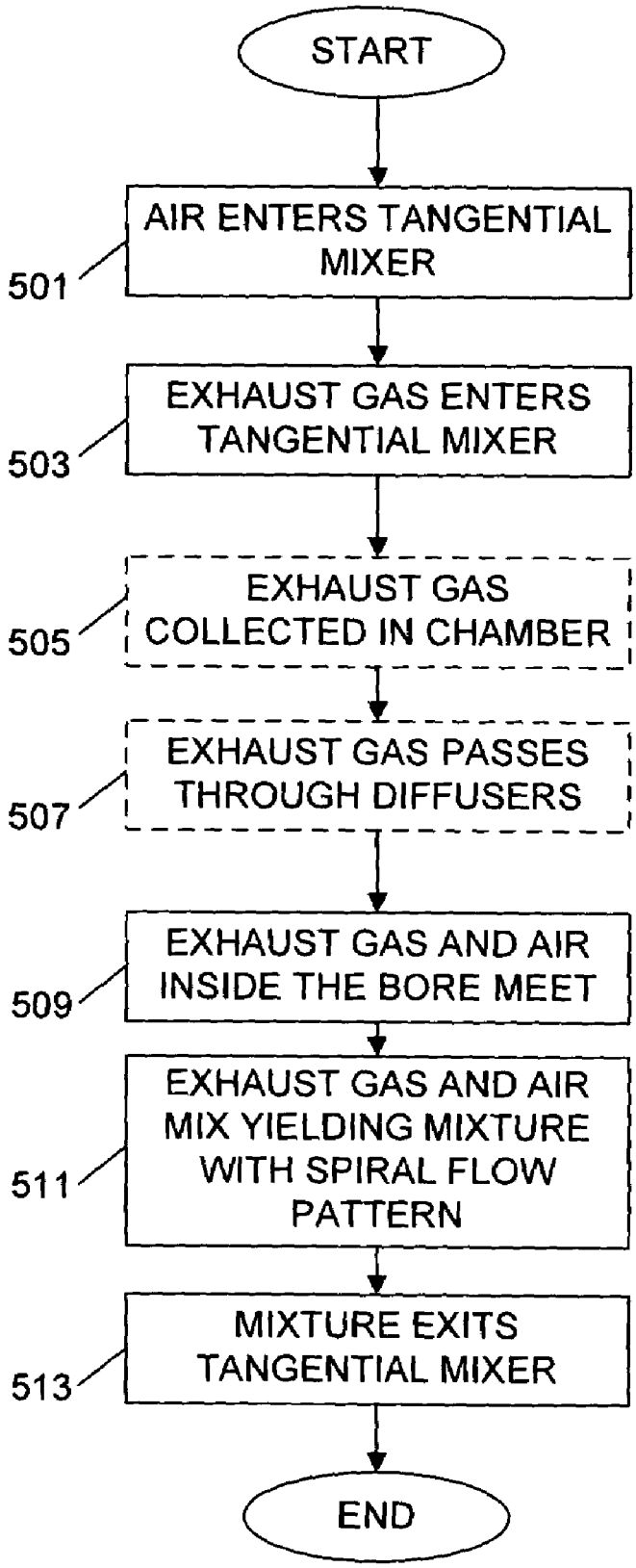
FIG. 5 is a flowchart for a method of mixing air and exhaust gas in accordance with the invention.

A method for mixing air and exhaust gas using the tangential mixture 200, with an optional step for the tangential mixer 400 having an inner bore 401, is shown in FIG. 5. Air enters the tangential mixer 200 from the air inlet 207 in step 501, and exhaust gas enters the tangential mixer from the inlet bores 211 in step 503. If a mixer 400 is used, an optional step of collecting exhaust gas in the chamber 409 in step 505. The exhaust gas in the chamber 409 passes through the diffusers 411 having a radial component of velocity in step 507, before mixing with the air. The exhaust gas from the inlet bores 211 meets the air traveling inside the bore 205 in step 509. Exhaust gas entering the bore 205 has a tangential component of velocity. Air traveling inside the bore 205 has an axial component of velocity along the centerline 213 of the bore 205. When the exhaust gas and air meet, their molecules begin to mix, and their velocities combine yielding a resultant velocity that has both a tangential and an axial component. This results in achieving a spiral pattern for the mixture of air and exhaust gas traveling through the mixer 200. This spiral pattern enables effective mixing of air and exhaust gas in step 511.

Figure 6:
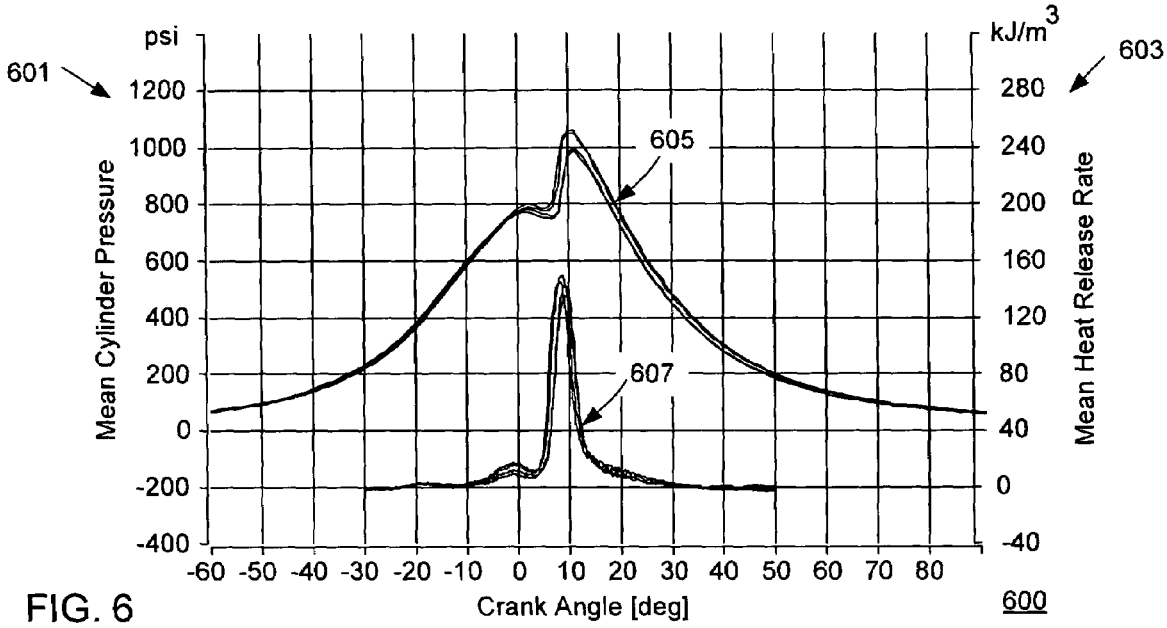
FIG. 6 is a chart showing representative experimental data of an engine in accordance with the invention.

The mixture exits the mixer 200 or 400 in step 513, and subsequently enters an internal combustion engine. A measure of effectiveness of mixing may be a comparison of mean cylinder pressure (MCP) and mean heat release (MHR) between cylinders during a combustion event. A graph 600 showing a time aligned trace of MCP and MHR for an 8 cylinder diesel engine is shown in FIG. 6. In a first experiment, an engine ran at full load using 33% by volume exhaust gas to fresh air ratio, or 33% exhaust gas recirculation (EGR) ratio as is known in the art. Crank angle is plotted on a horizontal axis. MCP, measured in pounds per square inch (PSI), is measured on a first vertical axis 601.

MHR measured in kilo-Joules (kJ) per cubic meter is plotted on a second vertical axis 603. A first family of curves 605 represents the time aligned traces of each of the MCP overlaid for each of the engine's 8 cylinders, and a second family of curves 607 represents the time aligned traces of MHP for each of the 8 cylinders.

In a second experiment, the engine ran at 50% load, and 55% EGR. Tabulated results for both experiments are shown in the following table. Representative results comparing two of the engine's cylinders, in this case cylinders number 5 and 6, are presented as illustrative.

| | | | | | Units |
|---|---|---|---|---|---|
| Speed | 1370 | 1370 | 1370 | 1370 | RPM |
| Eng. Load | 50 | 50 | 100 | 100 | (%) |
| % EGR | 55 | 55 | 33 | 33 | (%) |
| Cylinder | #5 | #6 | #5 | #6 | |
| MHR Min | 138.0 | 135.4 | 239.9 | 237.2 | $\frac{kJ}{m^3}$ |
| MHR Mean | 149.9 | 146.0 | 249.1 | 244.6 | |
| MHR Max | 159.3 | 157.7 | 255.8 | 252.4 | |
| CoV % | 3.16 | 3.46 | 1.34 | 1.51 | |

In the table above, "Speed" is the running speed of the engine expressed in revolutions per minute (RPM), "Eng. Load" is the torque loading of the engine expressed as a percentage (%) of rated torque, "% EGR" is the percentage of exhaust gas to fresh air ratio the engine is running, and "Cylinder" is the cylinder number designation for which the measurements are presented. The minimum, mean, and maximum values of the MHR for each of the cylinders under the two experiments are tabulated, and the coefficient of variance (CoV %) between these measurements is also tabulated, expressed as a percentage to estimate the homogeneity of the exhaust gas and air mixture entering the cylinders of the engine.

As the results indicate, variance in the heat release of each cylinder, and therefore the variation of the combustion process due to material entering each cylinder is less than 3.5% under the 50% load and 55% EGR experiment. Similarly, the variation in the full load and 33% EGR experiment is about 1.5%. These variations represent a marked improvement over the variations observed on the same engine before the use of the tangential mixture.

Figure 7:
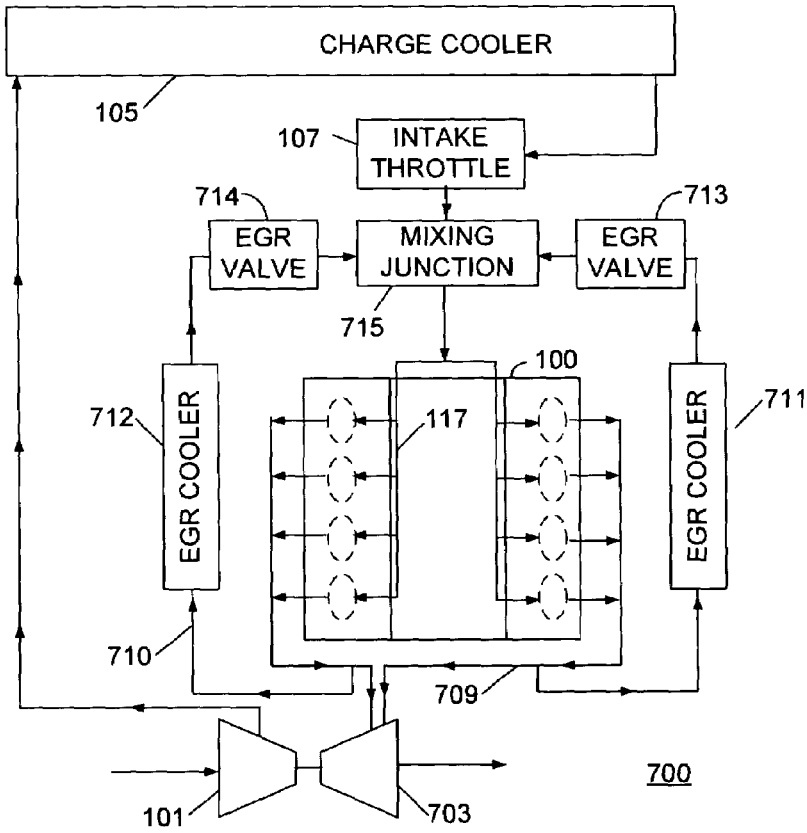
FIG. 7 is a block diagram of an alternate embodiment of an engine in accordance with the invention.

Use of the tangential mixture 200 finds special advantage when used on an engine having more than one supplies of exhaust gas for recirculation as, for example, in an engine having two banks of cylinders each driving a separate portion of an EGR system, as shown in FIG. 7. An engine 700 includes a right hand (RH) exhaust system 709, and a left hand (LH) exhaust system 710, connected at a turbocharger 703. The RH system 709 is connected to a first EGR cooler 711, and a first EGR valve 713. The first EGR valve 713 is connected to a tangential mixer 715. The LH system 710 is connected to a second EGR cooler 712, and a second EGR valve 714. The second EGR valve 714 is connected to the tangential mixer 715. The tangential mixer 715 may have two exhaust gas inlets (not shown), similar to the exhaust gas inlets 211 of FIG. 2A. Each of the exhaust gas inlets may advantageously be connected to each of the outlets of the EGR coolers 711, 712. The connections to each of the EGR cooler advantageously yields a balanced EGR system for the engine 700. For the sake of brevity, all other components shown in FIG. 7 that have not been mentioned are the same or similar as the components described in FIG. 1, and perform same or similar functions.

The tangential mixer 200 described earlier may be a separate component that is attached to the intake system of an engine as is known in the art. Alternatively, the tangential mixer 200 may be integrated with another component of the engine, for example, an intake manifold. Integration of the tangential mixer with an intake manifold of an engine is advantageous because there is no need for additional components or connections.

In a preferred embodiment, the tangential mixer is made of metal, preferably by using a casting method, for instance, sand casting, die casting, investment casting, and others, as is known in the art. The type of metal that advantageously may be used is an appropriate aluminum alloy, but other metals may be used. In the case where the tangential mixer is integrated with another component of the engine, the material for the tangential mixer may be the same as the material of the other component of the engine with which the mixer is integrated.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A method for mixing a first fluid and a second fluid using a tangential mixer, comprising the steps of:

directing the first fluid through a bore in a first direction;

guiding the second fluid through an inlet in a second direction;

collecting the second fluid in a chamber before mixing the first fluid and the second fluid;

mixing the first fluid and the second fluid to yield a mixture having a spiral flow pattern;

passing the second fluid radially through at least one diffuser;

wherein the first direction and the second direction are at an angle.

2. The method of claim 1, wherein the angle is less than 45 degrees.

3. The method of claim 1, wherein the first direction and the second direction are perpendicular and the angle is zero.

4. The method of claim 1, further comprising the step of adding the second fluid through more than one inlets.

5. An internal combustion engine comprising:

a crankcase having a plurality of cylinders;

an inlet system and an exhaust system in fluid communication with the plurality of cylinders;

a turbocharger in fluid communication with the intake system and the exhaust system;

an exhaust gas recirculation system in fluid communication with the exhaust system and the intake system;

a tangential mixer, disposed in the intake system and in fluid communication with the exhaust system, wherein the tangential mixer includes an inner bore, wherein the inner bore is disposed in the bore of the tangential mixer, wherein the inner bore has at least one diffuser hole, wherein the at least one diffuser hole is in fluid communication with the bore and the exhaust system, wherein the inner bore has a substantially cylindrical shape, the cylindrical shape having a radius, and wherein the at least one diffuser hole is disposed along a radial direction with respect to the inner bore.

6. The internal combustion engine of claim 5, wherein a mixture exiting the tangential mixture has a substantially spiral flow pattern.

7. The internal combustion engine of claim 5, wherein the tangential mixer includes a bore and at least one gas inlet.

8. The internal combustion engine of claim 7, wherein the at least one gas inlet is oriented tangentially to a perimeter of the bore.

9. A tangential mixer, comprising:

an air inlet and a mixture outlet;

a bore having a bore centerline and a bore perimeter;

at least one gas inlet having an inlet centerline that is oriented tangentially to the bore perimeter;

an inner bore, wherein the inner bore is disposed in the bore of the tangential mixer, wherein the inner bore has at least one diffuser hole, wherein the at least one diffuser hole is in fluid communication with the bore and the at least one gas inlet, wherein the inner bore has a substantially cylindrical shape, the cylindrical shape having a radius, and wherein the at least one diffuser hole is disposed along a radial direction with respect to the inner bore;

wherein the inlet centerline is within a cone, the cone having a vertex point on the inlet centerline.

10. The tangential mixer of claim 9, further comprising a chamber disposed between the bore and the inner bore.

11. The tangential mixer of claim 9, further comprising a second gas inlet, wherein the second gas inlet has a second inlet centerline.

12. The tangential mixer of claim 11, wherein the bore centerline is perpendicular to a plane defined by the inlet centerline and the second inlet centerline.

13. The tangential mixer of claim 9, wherein the cone has an included angle at the vertex.

14. The tangential mixer of claim 13, wherein the included angle is zero.

15. The tangential mixer of claim 13, wherein the included angle is less than 90 degrees.

* * * * *